US005500138A

United States Patent [19]

Bacon et al.

[11] Patent Number: 5,500,138

[45] Date of Patent: Mar. 19, 1996

[54] FABRIC SOFTENER COMPOSITIONS WITH IMPROVED ENVIRONMENTAL IMPACT

[75] Inventors: Dennis R. Bacon, Milford; Toan Trinh, Maineville, both of Ohio

[73] Assignee: The Procter & Gamble Company, Cincinnati, Ohio

[21] Appl. No.: 326,555

[22] Filed: Oct. 20, 1994

[51] Int. Cl.[6] ..... D06M 13/46; D06M 13/00

[52] U.S. Cl. ..... 252/8.8; 252/8.6; 252/8.7; 252/8.75

[58] Field of Search ..... 252/8.6, 8.8, 8.7, 252/8.75

[56] References Cited

U.S. PATENT DOCUMENTS

| | | | |
|---|---|---|---|
| 4,954,285 | 9/1990 | Wierenga et al. | 252/174.11 |
| 5,066,414 | 11/1991 | Chang | 252/8.8 |
| 5,185,088 | 2/1993 | Hartman et al. | 252/8.6 |
| 5,368,756 | 11/1994 | Vogel et al. | 252/8.8 |

OTHER PUBLICATIONS

"A Quantitative Study of Factors that Influence the Substantivity of Fragrance Chemicals on Laundered and Dried Fabrics", Escher et al., JAOCS, vol. 71, No. 1 (Jan. 1994).

"What Makes a Fragrance Substantive?", Muller et al., Givaudan–Roure Research Ltd., CH–6800 Dubendorf Switzerland (Oct. 1992).

S. Archtander, "Perfume and Flavor Chemicals", (1969).

R. C. Weast, "CRC Handbook of Chemistry and Physics", 65th Edition, (1985).

Murugan et al, "Predicting Physical Properties From Molecular Structure", Chemtech, pp. 17–21 (Jun. 1994).

Gordon et al, "The Chemist's Companion", Section III–Empirical Boling Point Pressure Relationships, pp. 30–36, (No date).

Albert Leo, "Methods of Calculating Partition Coefficients", pp. 295–319, (No date).

*Primary Examiner*—Anthony Green

*Attorney, Agent, or Firm*—Robert B. Aylor

[57] ABSTRACT

The present invention relates to liquid and solid biodegradable fabric softener compositions combined with highly enduring substantive perfumes. These compositions are naturally, or synthetically, derived perfumes which are hydrophobic, defined by having a low rinse water solubility (ClogP is greater than or equal to 3.0). These perfumes also have low volatility, a boiling point of 250° C., or greater. These compositions provide better perfume deposition on treated fabric, and consequently are not substantially lost during the rinse and drying cycle for less impact on the environment. Also, these perfumes improve the physical stability of the softener composition.

34 Claims, No Drawings

FABRIC SOFTENER COMPOSITIONS WITH IMPROVED ENVIRONMENTAL IMPACT

FIELD OF THE INVENTION

The present invention relates to liquid and rinse-added granular, biodegradable fabric softener compositions combined with efficient enduring perfume compositions. These compositions contain naturally, and/or synthetically, derived perfumes which are substantive to fabrics. These compositions provide better perfume deposition on treated fabric, minimize the perfume lost during the laundry processes, and consequently are not substantially lost during the rinse and drying cycle for less impact on the environment. Also, these perfumes improve the physical stability of the softener composition.

BACKGROUND OF THE INVENTION

Perfume delivery and longevity on fabrics from fabric softening compositions are especially important functions of these fabric softening compositions to provide an olfactory aesthetic benefit and to serve as a signal that fabrics are clean. Continuous efforts are made for improvements. Generally these improvements center around the proper selection of carrier materials to improve deposition of the perfume onto the fabric, controlling the rate of release of the perfume, and the proper selection of the perfume components. For example, carriers, such as microcapsules and cyclodextrin, are disclosed for example in U.S. Pat. No. 5,112,688, issued May 12, 1992 to D. W. Michael and U.S. Pat. No. 5,234,611, issued Aug. 10, 1993 to Trinh, Bacon, and Benvegnu, said patents being incorporated herein by reference. While these improvements are useful, they do not solve all problems associated with perfume delivery and longevity from fabric softening compositions.

In the rinse cycle of the laundry process, a substantial amount of perfume in the fabric softener composition can be lost when the rinse water is spun out (in a washing machine), or wrung out (during hand washing), even if the perfume is encapsulated or included in a carrier.

Furthermore, due to the high energy input and large air flow in the drying process used in the typical automatic laundry dryers, a large part of most perfumes provided by fabric softener products is lost from the dryer vent. Perfume can be lost even when the fabrics are line dried. Concurrent with effort to reduce the environmental impact of fabric softener compositions, by the development of rapidly biodegradable softener ingredients, see, for instance, copending U.S. patent application Ser. No. 08/142,739, filed Oct. 25, 1993, Wahl, et al., and U.S. patent application Ser. No. 08/101,130, filed Aug. 2, 1993, Baker, et al.; it is desirable to formulate efficient, enduring fabric softener perfume compositions that remain on fabric for aesthetic benefit, and are not lost, or wasted, without benefiting the laundered clothes.

The present invention provides improved compositions with less environmental impact due to using a combination of biodegradable softener and efficient perfumes in rinse-added fabric softening compositions while, surprisingly, also providing improved longevity of perfumes on the laundered clothes, by utilizing enduring perfume compositions. Furthermore, surprisingly, the efficient perfumes also improve the viscosity stability of the softener compositions as compared to similar compositions containing more traditional perfumes.

SUMMARY OF THE INVENTION

The present invention relates to rinse-added fabric softening compositions selected from the group consisting of:

I. a solid particulate composition comprising:

(A) from about 50% to about 95% of biodegradable cationic, preferably diester, quaternary ammonium fabric softening compound, preferably from about 60% to about 90%, of said softening compound;

(B) from about 0.01% to about 15% of an enduring perfume composition;

(C) from 0% to about 30% of dispersibility modifier; and (D) from 0% to about 10% of a pH modifier; and II. a liquid composition comprising:

(A) from about 0.5% to about 80% of biodegradable cationic, preferably diester, quaternary ammonium fabric softening compound, preferably from about 1% to about 35%, and more preferably from about 4% to about 32%, of said biodegradable softening compound;

(B) from about 0.01% to about 10% of an enduring perfume composition;

(C) from 0% to about 30% of dispersibility modifier wherein the dispersibility modifier affects the composition's viscosity, dispersibility in a laundry process rinse cycle, or both; and (D) the balance comprising a liquid carrier selected from the group consisting of water, $C_1$–$C_4$ monohydric alcohols, $C_2$–$C_6$ polyhydric alcohols, liquid polyalkylene glycols, and mixtures thereof; and wherein the enduring perfume has at least about 70% of its components with a ClogP≧3.0 and a boiling point of≧250° C.

A particularly preferred liquid composition comprises:

(A) from about 15% to about 50% of biodegradable quaternary ammonium fabric softening compound;

(B) from about 0.05% to about 6% of an enduring perfume composition;

(C) from 0% to about 5% of dispersibility modifier selected from the group consisting of:

1. single-long-chain-$C_{10}$–$C_{22}$ alkyl, cationic surfactant;
2. nonionic surfactant with at least 8 ethoxy moieties; and
3. mixtures thereof;

(D) from 0% to about 1% of a stabilizer;

(E) from about 0.01% to about 2% electrolyte; and (F) the balance comprising a liquid carrier selected from the group consisting of water, $C_1$–$C_4$ monohydric alcohols, $C_2$–$C_6$ polyhydric alcohols, liquid polyalkylene glycols, and mixtures thereof.

DETAILED DESCRIPTION OF THE INVENTION

The present invention relates to rinse-added fabric softening compositions selected from the group consisting of:

I. a solid particulate composition comprising:

(A) from about 50% to about 95% of biodegradable cationic, preferably diester, quaternary ammonium fabric softening compound, preferably from about 60% to about 90%, of said softening compound;

(B) from about 0.01% to about 15% of an enduring perfume composition;

(C) from 0% to about 30% of dispersibility modifier; and (D) from 0% to about 10% of a pH modifier; and II. a liquid composition comprising:

(A) from about 0.5% to about 80% of biodegradable cationic, preferably diester, quaternary ammonium fabric softening compound, preferably from about 1% to about 35%, and more preferably from about 4% to about 32%, of said biodegradable softening compound;

(B) from about 0.01% to about 10% of an enduring perfume composition;

(C) from 0% to about 30% of dispersibility modifier wherein the dispersibility modifier affects the composition's viscosity, dispersibility in a laundry process rinse cycle, or both; and (D) the balance comprising a liquid carrier selected from the group consisting of water, $C_1$–$C_4$ monohydric alcohols, $C_2$–$C_6$ polyhydric alcohols, liquid polyalkylene glycols, and mixtures thereof, and wherein the enduring perfume has at least about 70% of its components with a ClogP≧3.0 and a boiling point of ≧250° C.

A particularly preferred liquid composition comprises:

(A) from about 15% to about 50% of biodegradable diester quaternary ammonium fabric softening compound;

(B) from about 0.05% to about 6% of an enduring perfume composition;

(C) from 0% to about 5% of dispersibility modifier selected from the group consisting of:

1. single-long-chain-$C_{10}$–$C_{22}$ alkyl, cationic surfactant;
2. nonionic surfactant with at least 8 ethoxy moieties;
3. amine oxide surfactant; or
4. mixtures thereof (D) from 0% to about 1% of a stabilizer;

(E) from about 0.01% to about 2% electrolyte; and (F) the balance comprising a liquid carrier selected from the group consisting of water, $C_1$–$C_4$ monohydric alcohols, $C_2$–$C_6$ polyhydric alcohols, liquid polyalkylene glycols, and mixtures thereof.

Water can be added to the particulate solid granular compositions to form dilute or concentrated liquid softener compositions with a concentration of said biodegradable quaternary ammonium fabric softening compound of from about 0.5% to about 50%, preferably from about 1% to about 35%, more preferably from about 4% to about 32%. The liquid and granular biodegradable fabric softener compositions can be added directly in the rinse both to provide adequate usage concentration, e.g., from about 10 to about 1,000 ppm, preferably from about 30 to about 500 ppm, of the biodegradable, cationic fabric softener compound, or water can be pre-added to the particulate, solid, granular composition to form dilute or concentrated liquid softener compositions that can be added to the rinse to provide the same usage concentration.

(A) Biodegradable Quaternary Ammonium Fabric Softening Compounds

The compounds of the present invention are biodegradable quaternary ammonium compounds, preferably diester compounds, wherein the fatty acyl groups have an Iodine Value (IV) of from greater than about 5 to less than about 100, a cis/trans isomer weight ratio of greater than about 30/70 when the IV is less than about 25, the level of unsaturation being less than about 65% by weight, wherein said compounds are capable of forming concentrated aqueous compositions with concentrations greater than about 13% by weight at an IV of greater than about 10 without viscosity modifiers other than normal polar organic solvents present in the raw material of the compound or added electrolyte, and wherein any fatty acyl groups from tallow are preferably modified, especially to reduce their odor. The present invention relates to fabric softening compositions comprising biodegradable quaternary ammonium compounds, preferably diester compounds (DEQA), preferably having the formula:

$$(R)_{4-m}—N^+—[(CH_2)_n—Y—R^1]_m\ X^- \qquad (I)$$

wherein: each Y=—O—(O)C—, or —C(O)—O—; m=2 or 3; each n=1 to 4; each R substituent is a short chain $C_1$–$C_6$, preferably $C_1$–$C_3$, alkyl group, e.g., methyl (most preferred), ethyl, propyl, and the like, benzyl, $C_1$–$C_6$, preferably $C_1$–$C_3$, hydroxy alkyl group, e.g., 2-hydroxy ethyl, 2-hydroxy propyl, 3-hydroxy propyl, and the like, or mixtures thereof, each $R^1$ is $C_{11}$–$C_{22}$ hydrocarbyl, or substituted hydrocarbyl substituent, $R^1$ is preferably partially unsaturated (with Iodine Value (IV) of greater than about 5 to less than about 100), and the counterion, $X^-$, can be any suitable softener-compatible anion, for example, chloride, bromide, methylsulfate, formate, sulfate, nitrate and the like;

Any reference to IV values hereinafter refers to the Iodine Value of fatty acyl groups and not to the resulting softener compound.

When the IV of the fatty acyl groups is above about 20, the softener provides excellent antistatic effect. Antistatic effects are especially important where the fabrics are dried in a tumble dryer, and/or where synthetic materials which generate static are used. Maximum static control occurs with an IV of greater than about 20, preferably greater than about 40. When fully saturated softener compounds are used in the compositions, poor static control results. Also, as discussed hereinafter, concentratability increases as IV increases. The benefits of concentratability include: use of less packaging material; use of less organic solvents, especially volatile organic solvents; use of less concentration aids which may add nothing to performance; etc.

As the IV is raised, there is a potential for odor problems. Surprisingly, some highly desirable, readily available sources of fatty acids such as tallow, possess odors that remain with the softener compounds despite the chemical and mechanical processing steps which convert the raw tallow to finished active. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or performance which was not heretofore recognized. For example, DEQA containing unsaturated fatty acyl groups having an IV greater than about 10 can be concentrated above about 13% without the need for additional concentration aids, especially surfactant concentration aids as discussed hereinafter.

The above softener actives derived from highly unsaturated fatty acyl groups, i.e., fatty acyl groups having a total unsaturation above about 65% by weight, do not provide any additional improvement in antistatic effectiveness. They may, however, be able to provide other benefits such as improved water absorbency of the fabrics. In general, an IV range of from about 40 to about 65 is preferred for concentratability, maximization of fatty acyl sources, excellent softness, static control, etc.

Highly concentrated aqueous dispersions of these softener compounds can gel and/or thicken during low (40° F.) temperature storage. Softener compounds made from only unsaturated fatty acids minimizes this problem but additionally is more likely to cause malodor formation. Surprisingly, compositions from these softener compounds made from fatty acids having an IV of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature with minimal odor formation. These cis/trans isomer weight ratios provide optimal concentratability at these IV ranges. In the IV range above about 25, the ratio of cis to trans isomers is less important unless higher concentrations are needed. The relationship between IV and concentratability is described hereinafter. For any IV, the concentration that will be stable in an aqueous composition will depend on the criteria for stability (e.g., stable down to about 5° C.; stable down to 0° C.; doesn't gel; gels but recovers on heating, etc.) and the other ingredients present, but the concentration that is stable can be raised by adding the concentration aids, described hereinafter in more detail, to achieve the desired stability.

Generally, hydrogenation of fatty acids to reduce polyunsaturation and to lower IV to insure good color and improve odor and odor stability leads to a high degree of trans configuration in the molecule. Therefore, diester compounds derived from fatty acyl groups having low IV values can be made by mixing fully hydrogenated fatty acid with touch hydrogenated fatty acid at a ratio which provides an IV of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc. Touch hardened fatty acid with high cis/trans isomer weight ratios is available commercially (i.e., Radiacid 406 from FINA).

It has also been found that for good chemical stability of the diester quaternary compound in molten storage, moisture level in the raw material must be controlled and minimized preferably less than about 1% and more preferably less than about 0.5% water. Storage temperatures should be kept as low as possible and still maintain a fluid material, ideally in the range of from about 49° C. to about 66° C. The optimum storage temperature for stability and fluidity depends on the specific IV of the fatty acid used to make the softener compound and the level/type of solvent selected. It is important to provide good molten storage stability to provide a commercially feasible raw material that will not degrade noticeably in the normal transportation/storage/handling of the material in manufacturing operations.

It will be understood that substituents R and $R^1$ can optionally be substituted with various groups such as alkoxyl or hydroxyl groups. The preferred compounds can be considered to be diester variations of ditallow dimethyl ammonium chloride (DTDMAC), which is a widely used fabric softener. At least 80% of the softener compound, i.e., DEQA is preferably in the diester form, and from 0% to about 20%, preferably less than about 10%, more preferably less than about 5%, can be monoester, i.e., DEQA monoester (e.g., containing only one —Y—$R^1$ group).

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

The following are non-limiting examples (wherein all long-chain alkyl substituents are straight-chain):

Saturated $[HO—CH(CH_3)CH_2][CH_3]^+N[CH_2CH_2OC(O)C_{15}H_{31}]_2$ $Br^-$ $[C_2H_5]_2{}^+N[CH_2CH_2OC(O)C_{17}H_{35}]_2$ $Cl^-$ $[CH_3][C_2H_5]^+N[CH_2CH_2OC(O)C_{13}H_{27}]_2$ $I^-$ $[C_3H_7][C_2H_5]^+N[CH_2CH_2OC(O)C_{15}H_{31}]_2$ $SO_4CH_3{}^-$ $(CH_3)_2{}^+N—[CH_2CH_2OC(O)C_{17}H_{35}]$ $[CH_2CH_2OC(O)C_{15}H_{31}]$ $Cl^-$ $[CH_3]_2{}^+N[CH_2CH_2OC(O)R^2]_2$ $Cl^-$ where —$C(O)R^2$ is derived from saturated tallow.

Unsaturated $[HO—CH(CH_3)CH_2][CH_3]^+N[CH_2CH_2OC(O)C_{15}H_{29}]_2$ $Br^-$ $[C_2H_5]_2{}^+N[CH_2CH_2OC(O)C_{17}H_{33}]_2$ $Cl^-$ $[CH_3][C_2H_5]^+N[CH_2CH_2OC(O)C_{13}H_{25}]_2$ $I^-$ $[C_3H_7][C_2H_5]^+N[CH_2CH_2OC(O)C_{15}H_{29}]_2$ $SO_4$ $CH_3{}^-$ $[CH_3]_2{}^+N—[CH_2CH_2OC(O)C_{17}H_{33}]$ $[CH_2CH_2OC(O)C_{15}H_{29}]$ $Cl^-$ $[CH_2CH_2OH][CH_3]^+N[CH_2CH_2OC(O)R^2]_2$ $Cl^-$ $[CH_3]_2{}^+N[CH_2CH_2OC(O)R^2]_2$ $Cl^-$ where —$C(O)R^2$ is derived from partially hydrogenated tallow or modified tallow having the characteristics set forth herein.

It is especially surprising that careful pH control can noticeably improve product odor stability of compositions using unsaturated softener compound.

In addition, since the foregoing compounds (diesters) are somewhat labile to hydrolysis, they should be handled rather carefully when used to formulate the compositions herein. For example, stable liquid compositions herein are formulated at a pH (neat) in the range of from about 2 to about 5, preferably from about 2 to about 4.5, more preferably from about 2 to about 4. For best product odor stability, when the IV is greater that about 25, the neat pH is from about 2.8 to about 3.5, especially for lightly scented products. This appears to be true for all of the above softener compounds and is especially true for the preferred DEQA specified herein, i.e., having an IV of greater than about 20, preferably greater than about 40. The limitation is more important as IV increases. The pH can be adjusted by the addition of a Bronsted acid. pH ranges for making chemically stable softener compositions containing diester quaternary ammonium fabric softening compounds are disclosed in U.S. Pat. No. 4,767,547, Straathof et al., issued on Aug. 30, 1988, which is incorporated herein by reference.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, and citric acids.

The diester quaternary ammonium fabric softening compound (DEQA) can also have the general formula:

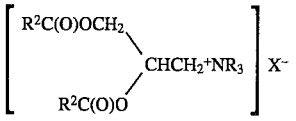

wherein each R, $R^2$, and the counterion $X^-$ have the same meanings as before. Such compounds include those having the formula:

$$[CH_3]_3{}^+N[CH_2CH(CH_2OC[O]R^2)OC(O)R^2]\ Cl^-$$

where $.OC(O)R^2$ is derived from hardened tallow.

Preferably each R is a methyl or ethyl group and preferably each $R^2$ is in the range of $C_{15}$ to $C_{19}$. Degrees of branching, substitution and/or non-saturation can be present in the alkyl chains. The anion $X^-$ in the molecule is preferably the anion of a strong acid and can be, for example, chloride, bromide, iodide, sulphate and methyl sulphate; the anion can carry a double charge in which case $X^-$ represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

Liquid compositions of this invention typically contain from about 0.5% to about 80%, preferably from about 1% to about 35%, more preferably from about 4% to about 32%, of biodegradable diester quaternary ammonium softener active. Concentrated compositions are disclosed in allowed U.S. patent application Ser. No. 08/169,858, filed Dec. 17, 1993, Swartley, et al., said application being incorporated herein by reference.

Particulate solid, granular compositions of this invention typically contain from about 50% to about 95%, preferably from about 60% to about 90% of biodegradable diester quaternary ammonium softener active.

(B) Perfumes

Fabric softener compositions in the art commonly contain perfumes to provide a good odor to fabrics. These conventional perfume compositions are normally selected mainly for their odor quality, with some consideration of fabric substantivity. Typical perfume compounds and compositions can be found in the art including U.S. Pat. Nos. 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

During the laundry process, a substantial amount of perfume in the rinse-added fabric softener composition is lost with the rinse water and in the subsequent drying (either line drying or machine drying). This has resulted in both a waste of unusable perfumes that are not deposited on laundered fabrics, and a contribution to the general air pollution from the release of volatile organic compounds to the air.

People, skilled in the art, usually by experience, have some knowledge of some particular perfume ingredients that are "fabric substantive". Fabric substantive perfume ingredients are those odorous compounds that effectively deposit on fabrics in the laundry process and are detectable on the laundered fabrics by people with normal olfactory acuity. The knowledge on what perfume ingredients are substantive is spotty and incomplete.

We have now discovered a class of enduring perfume ingredients that can be formulated into fabric softener compositions and are substantially deposited and remain on fabrics throughout the rinse and drying steps. These perfume ingredients, when used in conjunction with the rapidly biodegradable fabric softener ingredients, represent the most environmentally friendly fabric softener compositions, with minimum material waste, which still provide the good fabric feel and smell the consumers value. Additionally, these enduring perfume ingredients provide suiprisingly more stable liquid compositions, especially when the concentration of the biodegradable quaternary ammonium softenener is more than about 10%.

These enduring perfume ingredients are characterized by their boiling points (B.P.) and their octanol/water partitioning coefficient (P). Octanol/water partitioning coefficient of a perfume ingredient is the ratio between its equilibrium concentration in octanol and in water. The perfume ingredients of this invention has a B.P., measured at the normal, standard pressure, of about 250° C. or higher, e.g., more than about 260° C.; and an octanol/water partitioning coefficient P of about 1,000 or higher. Since the partitioning coefficients of the perfume ingredients of this invention have high values, they are more conveniently given in the form of their logarithm to the base 10, logP. Thus the perfume ingredients of this invention have logP of about 3 or higher, e.g., more than about 3.1 preferably more than about 3.2.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach on Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

The boiling points of many perfume ingredients are given in, e.g., "Perfume and Flavor Chemicals (Aroma Chemicals)," S. Arctander, published by the author, 1969, incorporated herein by reference. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30–36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306–316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301–310, and references cited therein, and "Predicting Physical Properties from Molecular Structure," R. Murugan et al, Chemtech, June 1994, pp. 17–23. All the above publications are incorporated herein by reference.

Thus, when a perfume composition which is composed primarily of ingredients having a B.P. at about 250° C., or higher, and a ClogP of about 3, or higher, is used in a softener composition, the perfume is very effectively deposited on fabrics and remains substantive on fabrics after the rinsing and drying (line or machine drying) steps.

TABLE 1

Examples of Enduring Perfume Ingredients

| Perfume Ingredients | Approximate B.P. (°C.) (a) | ClogP |
|---|---|---|
| BP > 250° C. and ClogP > 3.0 | | |
| Allyl cyclohexane propionate | 267 | 3.935 |
| Ambrettolide | 300 | 6.261 |
| Amyl benzoate | 262 | 3.417 |
| Amyl cinnamate | 310 | 3.771 |
| Amyl cinnamic aldehyde | 285 | 4.324 |
| Amyl cinnamic aldehyde dimethyl acetal | 300 | 4.033 |
| iso-Amyl salicylate | 277 | 4.601 |
| Aurantiol (Trade name for Hydroxy-citronellal-methylanthranilate) | 450 | 4.216 |
| Benzophenone | 306 | 3.120 |
| Benzyl salicylate | 300 | 4.383 |
| para-tert-Butyl cyclohexyl acetate | +250 | 4.019 |
| iso-Butyl quinoline | 252 | 4.193 |
| beta-Caryophyllene | 256 | 6.333 |
| Cadinene | 275 | 7.346 |
| Cedrol | 291 | 4.530 |
| Cedryl acetate | 303 | 5.436 |
| Cedryl formate | +250 | 5.070 |
| Cinnamyl cinnamate | 370 | 5.480 |
| Cyclohexyl salicylate | 304 | 5.265 |
| Cyclamen aldehyde | 270 | 3.680 |
| Dihydro isojasmonate | +300 | 3.009 |
| Diphenyl methane | 262 | 4.059 |
| Diphenyl oxide | 252 | 4.240 |
| Dodecalactone | 258 | 4.359 |
| iso E super (Trade name for 1-(1,2,3,4,5,6,7,8-Octahydro-2,3,8,8-tetramethyl-2-naphthalenyl)-ethanone) | +250 | 3.455 |
| Ethylene brassylate | 332 | 4.554 |
| Ethyl methyl phenyl glycidate | 260 | 3.165 |
| Ethyl undecylenate | 264 | 4.888 |
| Exaltolide (Trade name for 15-Hydroxyentadecanoic acid, lactone) | 280 | 5.346 |
| Galaxolide (Trade name for 1,3,4,6,7,8-Hexahydro-4,6,6,7,8,8-hexamethylcyclopenta-gamma-2-benzopyran) | +250 | 5.482 |
| Geranyl anthranilate | 312 | 4.216 |
| Geranyl phenyl acetate | +250 | 5.233 |
| Hexadecanolide | 294 | 6.805 |
| Hexenyl salicylate | 271 | 4.716 |
| Hexyl cinnamic aldehyde | 305 | 5.473 |
| Hexyl salicylate | 290 | 5.260 |
| alpha-Irone | 250 | 3.820 |
| Lilial (Trade name for para-tertiary-Butyl-alpha-methyl hydrocinnamic aldehyde) | 258 | 3.858 |
| Linalyl benzoate | 263 | 5.233 |
| 2-Methoxy naphthalene | 274 | 3.235 |
| Methyl dihydrojasmone | +300 | 4.843 |
| gamma-n-Methyl ionone | 252 | 4.309 |
| Musk indanone | +250 | 5.458 |

TABLE 1-continued

Examples of Enduring Perfume Ingredients

| Perfume Ingredients | Approximate B.P. (°C.) (a) | ClogP |
|---|---|---|
| Musk ketone | MP = 137° C. | 3.014 |
| Musk tibetine | MP = 136° C. | 3.831 |
| Myristicin | 276 | 3.200 |
| Oxahexadecanolide-10 | +300 | 4.336 |
| Oxahexadecanolide-11 | MP = 35° C. | 4.336 |
| Patchouli alcohol | 285 | 4.530 |
| Phantolide (Trade name for 5-Acetyl-1,1,2,3,3,6-hexamethyl indan). | 288 | 5.977 |
| Phenyl ethyl benzoate | 300 | 4.058 |
| Phenylethylphenylacetate | 325 | 3.767 |
| Phenyl heptanol | 261 | 3.478 |
| Phenyl hexanol | 258 | 3.299 |
| alpha-Santalol | 301 | 3.800 |
| Thibetolide (Trade name for 15-Hydroxypentadecanoic acid, lactone). | 280 | 6.246 |
| delta-Undecalactone | 290 | 3.830 |
| gamma-Undecalactone | 297 | 4.140 |
| Vetiveryl acetate | 285 | 4.882 |
| Yara-yara | 274 | 3.235 |
| Ylangene | 250 | 6.268 |

(a) M.P. is melting point; these ingredients have a B.P. higher than 250° C.

Table 1 gives some non-limiting examples of enduring perfume ingredients, useful in softener compositions of the present invention. The enduring perfume compositions of the present invention contain at least about 3 different enduring perfume ingredients, more preferably at least about 4 different enduring perfume ingredients, and even more preferably at least about 5 different enduring perfume ingredients. Furthermore, the enduring perfume compositions of the present invention contain at least about 70 Wt. % of enduring perfume ingredients, preferably at least about 75 Wt. % of enduring perfume ingredients, more preferably at least about 85 Wt. % of enduring perfume ingredients. Fabric softening compositions of the present invention contain from about 0.01% to about 15%, preferably from about 0.05% to about 8%, more preferably from about 0.1% to about 6%, and even more preferably from about 0.15% to about 4%, of an enduring perfume composition.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. These materials are not counted in the formulation of the enduring perfume compositions of the present invention.

TABLE 4

Examples of Non-Enduring Perfume Ingredients

| Perfume Ingredients | Approximate B.P. (°C.) | ClogP |
|---|---|---|
| BP < 250° C. and ClogP < 3.0 | | |
| Benzaldehyde | 179 | 1.480 |
| Benzyl acetate | 215 | 1.960 |
| laevo-Carvone | 231 | 2.083 |
| Geraniol | 230 | 2.649 |
| Hydroxycitronellal | 241 | 1.541 |
| cis-Jasmone | 248 | 2.712 |
| Linalool | 198 | 2.429 |
| Nerol | 227 | 2.649 |
| Phenyl ethyl alcohol | 220 | 1.183 |

TABLE 4-continued

| Examples of Non-Enduring Perfume Ingredients | | |
|---|---|---|
| Perfume Ingredients | Approximate B.P. (°C.) | ClogP |
| alpha-Terpineol | 219 | 2.569 |
| BP > 250° C. and ClogP < 3.0 | | |
| Coumarin | 291 | 1.412 |
| Eugenol | 253 | 2.307 |
| iso-Eugenol | 266 | 2.547 |
| Indole | 254 decompos | 2.142 |
| Methyl cinnamate | 263 | 2.620 |
| Methyl dihydrojasmonate | +300 | 2.275 |
| Methyl-N-methyl anthranilate | 256 | 2.791 |
| beta-Methyl naphthyl ketone | 300 | 2.275 |
| delta-Nonalactone | 280 | 2.760 |
| Vanillin | 285 | 1.580 |
| BP < 250° C. and ClogP > 3.0 | | |
| iso-Bornyl acetate | 227 | 3.485 |
| Carvacrol | 238 | 3.401 |
| alpha-Citronellol | 225 | 3.193 |
| para-Cymene | 179 | 4.068 |
| Dihydro myrcenol | 208 | 3.030 |
| Geranyl acetate | 245 | 3.715 |
| d-Limonene | 177 | 4.232 |
| Linalyl acetate | 220 | 3.500 |
| Vertenex | 232 | 4.060 |

Non-enduring perfume ingredients, which are preferably minimized in softener compositions of the present invention, are those having a B.P. of less than about 250° C., or having a ClogP of less than about 3.0, or having both a B.P. of less than about 250° C. and a ClogP of less than about 3.0. Table 2 gives some non-limiting examples of non-enduring perfume ingredients. In some particular fabric softener compositions, some non-enduring perfume ingredients can be used in small amounts, e.g., to improve product odor. However, to minimize waste and pollution, the enduring perfume compositions of the present invention contain less than about 30 Wt. % of non-enduring perfume ingredients, preferably less than about 25 Wt. % of non-enduring perfume ingredients, more preferably less than about 20 Wt. % of non-enduring perfume ingredients, and even more preferably less than about 15 Wt. % of non-enduring perfume ingredients.

(C). Optional Viscosity/Dispersibility Modifiers

Viscosity/dispersibility modifiers can be added for the purpose of facilitating the solubilization and/or dispersion of the solid compositions, concentrating the liquid compositions, and/or improving phase stability (e.g., viscosity stability) of the liquid compositions herein, including the liquid compositions formed by adding the solid compositions to water.

(1) Single-Long-Chain Alkyl Cationic Surfactant

The mono-long-chain-alkyl (water-soluble) cationic surfactants:

(a) in particulate, granular solid compositions are at a level of from 0% to about 30%, preferably from about 3% to about 15%, more preferably from about 5% to about 15%, and (b) in liquid compositions are at a level of from 0% to about 30%, preferably from about 0.5% to about 10%, the total single-long-chain cationic surfactant present being at least at an effective level.

Such mono-long-chain-alkyl cationic surfactants useful in the present invention are, preferably, quaternary ammonium salts of the general formula:

$$[R^2N^+R_3]\ X^-$$

wherein the $R^2$ group is a $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester; each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is preferably added to the composition of the present invention. The ranges do not include the amount of monoester which is already present in component (A), the diester quaternary ammonium compound, the total present being at least at an effective level.

The long chain group $R^2$, of the single-long-chain-alkyl cationic surfactant, typically contains an alkyl, or alkylene group having from about 10 to about 22 carbon atoms, preferably from about 12 to about 16 carbon atoms for solid compositions, and preferably from about 12 to about 18 carbon atoms for liquid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonated in the compositions and preferably during the rinse so that the amine has a cationic group. The composition is buffered (pH from about 2 to about 5, preferably from about 2 to about 4) to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to lower the composition's viscosity and/or increase the dispersibility of the diester softener compound and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

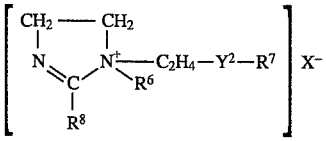

wherein $Y^2$ is —C(O)—O—, —O—(0)—C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

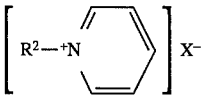

wherein $R^2$ and $X^-$ are as defined above. A typical material of this type is cetyl pyridinium chloride.

Amine oxides can also be used. Suitable amine oxides include those with one alkyl, or hydroxyalkyl, moiety of about 8 to about 22 carbon atoms, preferably from about 10 to about 18 carbon atoms, more preferably from about 12 to about 14 carbon atoms, and two alkyl moieties selected from the group consisting of alkyl groups and hydroxyalkyl groups containing from one to about three carbon atoms.

Examples of amine oxides include: dimethyloctylamine oxide; diethyldecylamine oxide; dimethyldodecylamine oxide; dipropyltetradecylamine oxide; dimethyl-2-hydroxyoctadecylamine oxide; dimethylcoconutalkylamine oxide; and bis-(2-hydroxyethyl)dodecylamine oxide.

(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc. They are referred to herein as ethoxylated fatty alcohols, ethoxylated fatty acids, and ethoxylated fatty amines.

Any of the alkoxylated materials of the particular type described hereinafter can be used as the nonionic surfactant. In general terms, the nonionics herein, when used alone, in solid compositions are at a level of from about 5% to about 20%, preferably from about 8% to about 15%, and in liquid compositions are at a level of from 0% to about 5%, preferably from about 0.1% to about 5%, more preferably from about 0.2% to about 3%. Suitable compounds are substantially water-soluble surfactants of the general formula:

$$R^2—Y—(C_2H_4O)_z—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, preferably —O—, and in which $R^2$, and R, when present, have the meanings given hereinbefore, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxy (EO) groups in the molecule.

(3) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallowalcohol-EO(11), tallowalcohol-EO(18), and tallowalcohol -EO(25).

(4) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

(5) Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

(6) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(7) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(8) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution.

The viscosity/dispersibility modifiers are present for solid compositions at a level of from about 3% to about 30%, preferably from about 5% to about 20%, and for liquid compositions at a level of from about 0.1% to about 30%, preferably from about 0.2% to about 20%, by weight of the composition.

As discussed hereinbefore, a potential source of water-soluble, cationic surfactant material is the DEQA itself. As a raw material, DEQA comprises a small percentage of monoester. Monoester can be formed by either incomplete esterification or by hydrolyzing a small amount of DEQA and thereafter extracting the fatty acid by-product. Generally, the composition of the present invention should only have low levels of, and preferably is substantially free of, free fatty acid by-product or free fatty acids from other sources because it inhibits effective processing of the composition. The level of free fatty acid in the compositions of the present invention is no greater than about 5% by weight of the composition and preferably no greater than 25% by weight of the diester quaternary ammonium compound.

Di-substituted imidazoline ester softening compounds, imidazoline alcohols, and monotallow trimethyl ammonium chloride are discussed hereinbefore and hereinafter.

(D) Liquid Carrier

The liquid carrier employed in the instant compositions is preferably water due to its low cost, relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and low molecular weight, e.g., < about 100, organic solvent, e.g., lower alcohol such as ethanol, propanol, isopropanol or butanol; propylene carbonate; and/or glycol ethers, are useful as the carrier liquid. Low molecular weight alcohols include monohydric, dihydric (glycol, etc.) trihydric (glycerol, etc.), and polyhydric (polyols) alcohols).

(E) Other Optional Ingredients

In addition to the above components, the composition can have one or more of the following optional ingredients.

1. Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof, more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzenesulfonic acid/sodium salt, and DTPA®, available from Aldrich with a chemical name of diethylenetriaminepentaacetic acid. The chemical names and CAS numbers for some of the above stabilizers are listed in Table II below.

TABLE II

| Antioxidant | CAS No. | Chemical Name used in Codeof Federal Regulations |
|---|---|---|
| Irganox ® 1010 | 6683-19-8 | Tetrakis [methylene(3,5-di-tert-butyl-4 hydroxyhydrocinnamate)] methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® B 1171 | 31570-04-4<br>23128-74-7 | 1:1 Blend of Irganox ® 1098 and Irgafos ® 168 |
| Irganox ® 1425 | 65140-91-2 | Calcium bis[monoethyl(3,5-di-tert-butyl-4-hydroxybenzyl)phosphonate] |
| Irganox ® 3114 | 65140-91-2 | Calcium bis[monoethyl(3,5-di-tert-butyl-4-hydroxybenzyl)phosphonate] |
| Irganox ® 3125 | 34137-09-2 | 3,5-Di-tert-butyl-4-hydroxy-hydrocinnamic acid triesterwith 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl) phosphite |

Examples of reductive agents include sodium borohydride, hypophosphorous acid, Irgafos® 168, and mixtures thereof.

2. Essentially Linear Fatty Acid and/or Fatty Alcohol Monoesters

Optionally, an essentially linear fatty monoester can be added in the composition of the present invention and is often present in at least a small amount as a minor ingredient in the DEQA raw material.

Monoesters of essentially linear fatty acids and/or alcohols, which aid said modifier, contain from about 12 to about 25, preferably from about 13 to about 22, more preferably from about 16 to about 20, total carbon atoms, with the fatty moiety, either acid or alcohol, containing from about 10 to about 22, preferably from about 12 to about 18, more preferably from about 16 to about 18, carbon atoms. The shorter moiety, either alcohol or acid, contains from about 1 to about 4, preferably from about 1 to about 2, carbon atoms. Preferred are fatty acid esters of lower alcohols, especially methanol. These linear monoesters are sometimes present in the DEQA raw material, or can be added to a DEQA premix as a premix fluidizer, and/or added to aid the viscosity/dispersibility modifier in the processing of the softener composition.

3. Optional Nonionic Softener

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the solid composition is typically from about 10% to about 40%, preferably from about 15% to about 30%, and the ratio of the optional nonionic softener to DEQA is from about 1:6 to about 1:2, preferably from about 1:4 to about 1:2. The level of optional nonionic softener in the liquid composition is typically from about 0.5% to about 10%, preferably from about 1% to about 5%.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens®] are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises ca. 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or diesters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

The performance of, e.g., glycerol and polyglycerol monoesters is improved by the presence of the diester cationic material, described hereinbefore.

Still other desirable optional "nonionic" softeners are ion pairs of anionic detergent surfactants and fatty amines, or quaternary ammonium derivatives thereof, e.g., those disclosed in U.S. Pat. No. 4,756,850, Nayar, issued Jul. 12, 1988, said patent being incorporated herein by reference. These ion pairs act like nonionic materials since they do not readily ionize in water. They typically contain at least two long hydrophobic groups (chains).

The ion-pair complexes can be represented by the following formula:

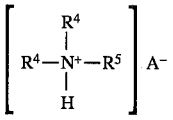

wherein each $R^4$ can independently be $C_{12}$–$C_{20}$ alkyl or alkenyl, and $R^5$ is H or $CH_3$. $A^-$ represents an anionic compound and includes a variety of anionic surfactants, as well as related shorter alkyl chain compounds which need not exhibit surface activity. $A^-$ is selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, olefin sulfonates, preferably benzene sulfonates, and $C_1$–$C_5$ linear alkyl benzene sulfonates, or mixtures thereof.

The terms "alkyl sulfonate" and "linear alkyl benzene sulfonate" as used herein shall include alkyl compounds having a sulfonate moiety both at a fixed location along the carbon chain, and at a random position along the carbon chain. Starting alkylamines are of the formula:

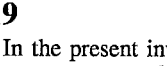

wherein each $R^4$ is $C_{12}$–$C_{20}$ alkyl or alkenyl, and $R^5$ is H or $CH_3$.

The anionic compounds ($A^-$) useful in the ion-pair complex of the present invention are the alkyl sulfonates, aryl sulfonates, alkylaryl sulfonates, alkyl sulfates, alkyl ethoxylated sulfates, dialkyl sulfosuccinates, ethoxylated alkyl sulfonates, alkyl oxybenzene sulfonates, acyl isethionates, acylalkyl taurates, and paraffin sulfonates.

The preferred anions ($A^-$) useful in the ion-pair complex of the present invention include benzene sulfonates and $C_1$–$C_5$ linear alkyl benzene sulfonates (LAS), particularly $C_1$–$C_3$ LAS. Most preferred is $C_3$ LAS. The benzene sulfonate moiety of LAS can be positioned at any carbon atom of the alkyl chain, and is commonly at the second atom for alkyl chains containing three or more carbon atoms.

More preferred are complexes formed from the combination of ditallow amine (hydrogenated or unhydrogenated) complexed with a benzene sulfonate or $C_1$–$C_5$ linear alkyl benzene sulfonate and distearyl amine complexed with a benzene sulfonate or with a $C_1$–$C_5$ linear alkyl benzene sulfonate. Even more preferred are those complexes formed from hydrogenated ditallow amine or distearyl amine complexed with a $C_1$–$C_3$ linear alkyl benzene sulfonate (LAS). Most preferred are complexes formed from hydrogenated ditallow amine or distearyl amine complexed with $C_3$ linear alkyl benzene sulfonate.

The amine and anionic compound are combined in a molar ratio of amine to anionic compound ranging from about 10:1 to about 1:2, preferably from about 5:1 to about 1:2, more preferably from about 2:1 to about 1:2, and most preferably 1:1. This can be accomplished by any of a variety of means, including but not limited to, preparing a melt of the anionic compound (in acid form) and the amine, and then processing to the desired particle size range.

A description of ion-pair complexes, methods of making, and non-limiting examples of ion-pair complexes and starting amines suitable for use in the present invention are listed in U.S. Pat. No. 4,915,854, Mao et al., issued Apr. 10, 1990, and U.S. Pat. No. 5,019,280, Caswell et al., issued May 28, 1991, both of said patents being incorporated herein by reference.

Generically, the ion pairs useful herein are formed by reacting an amine and/or a quaternary ammonium salt containing at least one, and preferably two, long hydrophobic chains ($C_{12}$–$C_{30}$, preferably $C_{11}$–$C_{20}$) with an anionic detergent surfactant of the types disclosed in said U.S. Pat. No. 4,756,850, especially at Col. 3, lines 29–47. Suitable methods for accomplishing such a reaction are also described in U.S. Pat. No. 4,756,850, at Col. 3, lines 48–65.

The equivalent ion pairs formed using $C_{12}$–$C_{30}$ fatty acids are also desirable. Examples of such materials are known to be good fabric softeners as described in U.S. Pat. No. 4,237,155, Kardouche, issued Dec. 2, 1980, said patent being incorporated herein by reference.

Other fatty acid partial esters useful in the present invention are ethylene glycol distearate, propylene glycol distearate, xylitol monopalmitate, pentaerythritol monostearate, sucrose monostearate, sucrose distearate, and glycerol monostearate. As with the sorbitan esters, commercially available mono-esters normally contain substantial quantities of di- or tri- esters.

Still other suitable nonionic fabric softener materials include long chain fatty alcohols and/or acids and esters thereof containing from about 16 to about 30, preferably from about 18 to about 22, carbon atoms, esters of such compounds with lower ($C_1$–$C_4$) fatty alcohols or fatty acids, and lower (1–4) alkoxylation ($C_1$–$C_4$) products of such materials.

These other fatty acid partial esters, fatty alcohols and/or acids and/or esters thereof, and alkoxylated alcohols and those sorbitan esters which do not form optimum emulsions/dispersions can be improved by adding other di-long-chain cationic material, as disclosed hereinbefore and hereinafter, or other nonionic softener materials to achieve better results.

The above-discussed nonionic compounds are correctly termed "softening agents," because, when the compounds are correctly applied to a fabric, they do impart a soft, lubricious feel to the fabric. However, they require a cationic material if one wishes to efficiently apply such compounds from a dilute, aqueous rinse solution to fabrics. Good deposition of the above compounds is achieved through their combination with the cationic softeners discussed hereinbefore and hereinafter. The fatty acid partial ester materials are preferred for biodegradability and the ability to adjust the HLB of the nonionic material in a variety of ways, e.g., by varying the distribution of fatty acid chain lengths, degree of saturation, etc., in addition to providing mixtures.

4. Optional Imidazoline Softening Compound

Optionally, the solid composition of the present invention contains from about 1% to about 30%, preferably from about 5% to about 20%, and the liquid composition contains from about 1% to about 20%, preferably from about 1% to about 15%, of a di-substituted imidazoline softening compound of the formula:

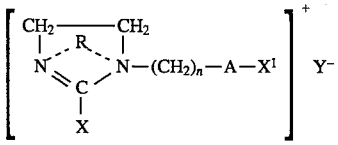

(I)

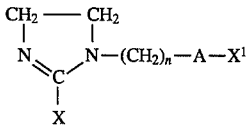

(II)

or mixtures thereof, wherein A is as defined hereinbefore for $Y^2$; $X^1$ and X are, independently, a $C_{11}$–$C_{22}$ hydrocarbyl group, preferably a $C_{13}$–$C_{18}$ alkyl group, most preferably a straight chained tallow alkyl group; R is a $C_1$–$C_4$ hydrocarbyl group, preferably a $C_1$–$C_3$ alkyl, alkenyl or hydroxyalkyl group, e.g., methyl (most preferred), ethyl, propyl, propenyl, hydroxyethyl, 2-, 3-di-hydroxypropyl and the like; and n is, independently, from about 2 to about 4, preferably about 2. The counterion $X^-$ can be any softener compatible anion, for example, chloride, bromide, methylsulfate, ethylsulfate, formate, sulfate, nitrate, and the like.

The above compounds can optionally be added to the composition of the present invention as a DEQA premix fluidizer or added later in the composition's processing for their softening, scavenging, and/or antistatic benefits. When these compounds are added to DEQA premix as a premix fluidizer, the compound's ratio to DEQA is from about 2:3 to about 1:100, preferably from about 1:2 to about 1:50.

Compound (I) can be prepared by quaternizing a substituted imidazoline ester compound. Quaternization may be achieved by any known quaternization method. A preferred quaternization method is disclosed in U.S. Pat. No. 4,954,635, Rosario-Jansen et al., issued Sep. 4, 1990, the disclosure of which is incorporated herein by reference.

The di-substituted imidazoline compounds contained in the compositions of the present invention are believed to be biodegradable and susceptible to hydrolysis due to the ester group on the alkyl substituent. Furthermore, the imidazoline compounds contained in the compositions of the present invention are susceptible to ring opening under certain conditions. As such, care should be taken to handle these compounds under conditions which avoid these consequences. For example, stable liquid compositions herein are preferably formulated at a pH in the range of about 1.5 to about 5.0, most preferably at a pH ranging from about 1.8 to 3.5. The pH can be adjusted by the addition of a Bronsted acid. Examples of suitable Bronsted acids include the inorganic mineral acids, carboxylic acids, in particular the low molecular weight ($C_1$–$C_5$) carboxylic acids, and alkylsulfonic acids. Suitable organic acids include formic, acetic, benzoic, methylsulfonic and ethylsulfonic acid. Preferred acids are hydrochloric and phosphoric acids. Additionally, compositions containing these compounds should be maintained substantially free of unprotonated, acyclic amines.

In many cases, it is advantageous to use a 3-component composition comprising: (A) a diester quaternary ammonium cationic softener such as di(tallowoyloxy ethyl) dimethylammonium chloride; (B) a viscosity/dispersibility modifier, e.g., mono-long-chain alkyl cationic surfactant such as fatty acid choline ester, cetyl or tallow alkyl trimethylammonium bromide or chloride, etc., a nonionic surfactant, or mixtures thereof; and (C) a di-long-chain imidazoline ester compound in place of some of the DEQA. The additional di-long-chain imidazoline ester compound, as well as providing additional softening and, especially, antistatic benefits, also acts as a reservoir of additional positive charge, so that any anionic surfactant which is carried over into the rinse solution from a conventional washing process is effectively neutralized.

5. Optional, but Highly Preferred, Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, their presence in such liquid compositions, even at levels which do not provide soil release benefits, is preferred.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred soil release agents are polymers of the generic formula:

$$X—(OCH_2CH_2)n—[O—C(O)—R^1—C(O)—O—R^2)_u—[O—C(O)—R^1—C(O)—O)—(CH_2CH_2O)_n—X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Patent Application 185,427, Gosselink, published Jun. 25, 1986, incorporated herein by reference.

6. Cellulase

The optional cellulase usable in the compositions herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of Humicola insolens (Humicola grisea var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention can be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labeled carboxymethyl-cellulose according to the $C^{14}$CMC-method described in EPA 350,098 (incorporated herein by reference in its entirety) at $25\times10^{-6}$% by weight of cellulase protein in the laundry test solution.

Most preferred cellulases are those as described in International Patent Application WO 91/17243, incorporated herein by reference in its entirety. For example, a cellulase preparation useful in the compositions of the invention can consist essentially of a homogeneous endoglucanase component, which is immunoreactive with an antibody raised against a highly purified 43kD cellulase derived from *Humicola insolens,* DSM 1800, or which is homologous to said 43kD endoglucanase.

The cellulases herein should be used in the liquid fabric-conditioning compositions of the present invention at a level equivalent to an activity from about 1 to about 125 CEVU/gram of composition [CEVU=Cellulase Equivalent Viscosity Unit, as described, for example, in WO 91/13 136, incorporated herein by reference in its entirety], and preferably an activity of from about 5 to about 100. The granular solid compositions herein typically contain a level of cellulase equivalent to an activity from about 1 to about 250 CEVU/gram of composition, preferably an activity of from about 10 to about 150.

7. Optional Bacteriocides

Examples of bacteriocides used in the compositions of this invention are glutaraldehyde, formaldehyde, 2-bromo-2-nitropropane-1,3-diol sold by Inolex Chemicals under the trade name Bronopol®, and a mixture of 5-chloro-2-methyl-4-isothiazolin-3-one and 2-methyl-4-isothiazoline-3-one sold by Rohm and Haas Company under the trade name Kathon® CG/ICP. Typical levels of bacteriocides used in the present compositions are from about 1 to about 1,000 ppm by weight of the composition.

8. Other Optional Ingredients

Inorganic viscosity control agents such as water-soluble, ionizable salts can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 4,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

The present invention can include other optional components conventionally used in textile treatment compositions, for example, dyes, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, antioxidants such as butylated hydroxy toluene, anti-corrosion agents, and the like.

In the method aspect of this invention, fabrics or fibers are contacted with an effective amount, generally from about 10 ml to about 150 ml (per 3.5 kg of fiber or fabric being treated) of the softener actives (including DEQA) herein in an aqueous bath. Of course, the amount used is based upon the judgment of the user, depending on concentration of the composition, fiber or fabric type, degree of softness desired, and the like. Preferably, the rinse bath contains from about 10 to about 1,000 ppm, preferably from about 50 to about 500 ppm, of the DEQA fabric softening compounds herein.

(F) Solid Particulate Compositions

As discussed hereinbefore, the invention also comprises solid particulate composition comprising:

(A) from about 50% to about 95%, preferably from about 60% to about 90%, of biodegradable cationic softening compound, preferably quaternary ammonium fabric softening compound;

(B) from about 0.01% to about 15%, preferably from about 0.05% to about 5%, of an enduring perfume composition;

(C) optionally, from 0% to about 30%, preferably from about 3% to about 15%, of dispersibility modifier; and (D) from 0% to about 10% of a pH modifier.

1. Optional pH Modifier

Since the biodegradable cationic diester quaternary ammonium fabric softener actives are somewhat labile to hydrolysis, it is preferable to include optional pH modifiers in the solid particulate composition to which water is to be added, to form stable dilute or concentrated liquid softener compositions. Said stable liquid compositions should have a pH (neat) of from about 2 to about 5, preferably from about 2 to about 4.5, more preferably from about 2 to about 4.

The pH can be adjusted by incorporating a solid, water soluble Bronsted acid. Examples of suitable Bronsted acids include inorganic mineral acids, such as boric acid, sodium bisulfate, potassium bisulfate, sodium phosphate monobasic, potassium phosphate monobasic, and mixtures thereof, organic acids, such as citric acid, fumaric acid, maleic acid, malic acid, tannic acid, gluconic acid, glutamic acid, tartaric acid, glycolic acid, chloroacetic acid, phenoxyacetic acid, 1,2,3,4-butane tetracarboxylic acid, benzene sulfonic acid, benzene phosphonic acid, ortho-toluene sulfonic acid, para-toluene sulfonic acid, phenol sulfonic acid, naphthalene sulfonic acid, oxalic acid, 1,2,4,5-pyromellitic acid, 1,2,4-trimellitic acid, adipic acid, benzoic acid, phenylacetic acid, salicylic acid, succinic acid, and mixtures thereof; and mixtures of mineral inorganic acids and organic acids. Preferred pH modifiers are citric acid, gluconic acid, tartaric acid, 1,2,3,4-butane tetracarboxylic acid, malic acid, and mixtures thereof.

Optionally, materials that can form solid clathrates such as cyclodextrins and/or zeolites, etc., can be used as adjuvants in the solid particulate composition as host carriers of concentrated liquid acids and/or anhydrides, such as acetic acid, HCl, sulfuric acid, phosphoric acid, nitric acid, carbonic acid, etc. An example of such solid clatherates is carbon dioxide adsorbed in zeolite A, as disclosed in U.S. Pat. No. 3,888,998, Whyte and Samps, issued Jun. 10, 1975 and U.S. Pat. No. 4,007,134, Liepe and Japikse, issued Feb. 8, 1977, both of said patents being incorporated herein by reference. Examples of inclusion complexes of phosphoric acid, sulfuric acid, and nitric acid, and process for their preparation are disclosed in U.S. Pat. No. 4,365,061, issued Dec. 21, 1982 to Szejtli et al., said patent being incorporated herein by reference.

When used, the pH modifier is typically used at a level of from about 0.01% to about 10%, preferably from about 0.1% to about 5%, by weight of the composition.

2. Preparation of Solid Particulate Granular Fabric Softener

The granules can be formed by preparing a melt, solidifying it by cooling, and then grinding and sieving to the desired size. In a three-component mixture, e.g., nonionic surfactant, single-long-chain cationic, and DEQA, it is more preferred, when forming the granules, to pre-mix the nonionic surfactant and the more soluble single-long-chain alkyl cationic compound before mixing in a melt of the diester quaternary ammonium cationic compound.

It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

3. Method of Use

Water can be added to the particulate, solid, granular compositions to form dilute or concentrated liquid softener compositions for later addition to the rinse cycle of the laundry process with a concentration of said biodegradable cationic softening compound of from about 0.5% to about 50%, preferably from about 1% to about 35%, more preferably from about 4% to about 32%,. The particulate, rinse-added solid composition (1) can also be used directly in the rinse bath to provide adequate usage concentration (e.g., from about 10 to about 1,000 ppm, preferably from about 50 to about 500 ppm, of total softener active ingredient). The liquid compositions can be added to the rinse to provide the same usage concentrations.

The water temperature for preparation should be from about 20° C. to about 90° C., preferably from about 25° C. to about 80° C. Single-long-chain alkyl cationic surfactants as the viscosity/dispersibility modifier at a level of from 0% to about 15%, preferably from about 3% to about 15%, more preferably from about 5% to about 15%, by weight of the composition, are preferred for the solid composition. Nonionic surfactants at a level of from about 5% to about 20%, preferably from about 8% to about 15%, as well as mixtures of these agents can also serve effectively as the viscosity/dispersibility modifier.

The emulsified/dispersed particles, formed when the said granules are added to water to form aqueous concentrates, typically have an average particle size of less than about 10 microns, preferably less than about 2 microns, and more preferably from about 0.2 to about 2 microns, in order that effective deposition onto fabrics is achieved. The term "average particle size," in the context of this specification, means a number average particle size, i.e., more than 50% of the particles have a diameter less than the specified size.

Particle size for the emulsified/dispersed particles is determined using, e.g., a Malvern particle size analyzer.

Depending upon the particular selection of nonionic and cationic surfactant, it may be desirable in certain cases, when using the solids to prepare the liquid, to employ an efficient means for dispersing and emulsifying the particles (e.g., blender).

Solid particulate compositions used to make liquid compositions may, optionally, contain electrolytes, perfume, antifoam agents, flow aids (e.g., silica), dye, preservatives, and/or other optional ingredients described hereinbefore.

The benefits of adding water to the particulate solid composition to form aqueous compositions to be added later to the rinse bath include the ability to transport less weight thereby making shipping more economical, and the ability to form liquid compositions similar to those that are normally sold to consumers, e.g., those that are described herein, with lower energy input (i.e., less shear and/or lower temperature). Furthermore, the particulate granular solid fabric softener compositions, when sold directly to the consumers, have less packaging requirements and smaller, more disposable containers. The consumers will then add the compositions to available, more permanent, containers, and add water to predilute the compositions, which are then ready for use in the rinse bath, just like the liquid compositions herein. The liquid form is easier to handle, since it simplifies measuring and dispensing.

In the specification and examples herein, all percentages, ratios and parts are by weight unless otherwise specified and all numerical limits are normal approximations.

The following Examples illustrate, but do not limit, the present invention. Five different perfume compositions are used in the following examples. Perfumes A and B are examples of enduring perfume compositions of this invention. Comparative Perfumes C, D, and E are non-enduring perfume compositions which are outside the scope of this invention.

Perfume A

| Perfume Ingredients | Approximate B.P. (°C.) | ClogP | Wt. % |
|---|---|---|---|
| Benzyl salicylate | 300 | 4.383 | 20 |
| Ethylene brassylate | 332 | 4.554 | 20 |
| Galaxolide - 50%[a] | +300 | 5.482 | 20 |
| Hexyl cinnamic aldehyde | 305 | 5.473 | 20 |
| Tetrahydro linalool | 191 | 3.517 | 20 |
| | | Total | 100 |

[a]A 50% solution in benzyl benzoate. Perfume A contains about 80% of enduring perfume components having BP > 250° C. and ClogP > 3.0.

Perfume B

| Perfume Ingredients | Approximate B.P. (°C.) | ClogP | Wt. % |
|---|---|---|---|
| Benzyl acetate | 215 | 1.960 | 4 |
| Benzyl salicylate | 300 | 4.383 | 12 |
| Coumarin | 291 | 1.412 | 4 |
| Ethylene brassylate | 332 | 4.554 | 10 |
| Galaxolide - 50%[a] | +300 | 5.482 | 10 |
| Hexyl cinnamic aldehyde | 305 | 4.853 | 20 |
| Lilial | 258 | 3.858 | 15 |
| Methyl dihydro isojasmonate | +300 | 3.009 | 5 |
| gamma-n-Methyl ionone | 252 | 4.309 | 10 |
| Patchouli alcohol | 283 | 4.530 | 4 |
| Tetrahydro linalool | 191 | 3.517 | 6 |
| | | Total | 100 |

[a]used as a 50% solution in isopropyl myristate which is not counted in the composition. Perfume B contains about 86% of enduring perfume components having BP > 250° C. and ClogP > 3.0.

Comparative Perfume C

| Perfume Ingredients | Approximate B.P. (°C.) | ClogP | Wt. % |
|---|---|---|---|
| Benzyl acetate | 215 | 1.960 | 20 |
| laevo-Carvone | 231 | 2.083 | 20 |
| Dihydro myrcenol | 208 | 3.030 | 20 |
| Hydroxycitronellal | 241 | 1.541 | 20 |
| Phenyl ethyl alcohol | 220 | 1.183 | 20 |
| | | Total | 100 |

Comparative Perfume D

| Perfume Ingredients | Approximate B.P. (°C.) | ClogP | Wt. % |
|---|---|---|---|
| Eugenol | 253 | 2.307 | 20 |
| iso-Eugenol | 266 | 2.547 | 20 |
| Fenchyl alcohol | 200 | 2.579 | 20 |
| Methyl dihydrojasmonate | +300 | 2.319 | 20 |
| Vanillin | 285 | 1.580 | 20 |
| | | Total | 100 |

Comparative Perfume E

| Perfume Ingredients | Approximate B.P. (°C.) | ClogP | Wt. % |
|---|---|---|---|
| Iso-Bornyl acetate | 227 | 3.485 | 20 |
| para-Cymene | 179 | 4.068 | 20 |
| d-Limonene | 177 | 4.232 | 20 |

-continued

| Comparative Perfume E | | | |
|---|---|---|---|
| Perfume Ingredients | Approximate B.P. (°C.) | ClogP | Wt. % |
| gamma-n-Methyl ionone | 252 | 4.309 | 20 |
| Tetrahydromyrcenol | 200 | 3.517 | 20 |
| | | Total | 100 |

Comparative Perfume E contains about 80% of non-enduring perfume ingredients having BP<250° C. and ClogP>3.0.

| Examples I and II | | |
|---|---|---|
| Components | I Wt. % | II Wt. % |
| Ester Quat Compound[1] | 10.1 | 10.1 |
| Perfume A | 0.45 | — |
| Perfume B | — | 0.45 |
| HCl (25%) | 0.06 | 0.06 |
| $CaCl_2$ (25%) | 0.06 | 0.06 |
| Deionized Water | Balance | Balance |

[1]Di(soft tallowoyloxyethyl) dimethyl ammonium chloride where the fatty acyl groups are derived from fatty acids with IV of about 55, % unsaturation of about 53.1, and $C_{18}$ cis/trans isomer ratio of about 8.2 (% cis isomer about 40.0 and % trans isomer about 4.9); the diester includes monoester at a weight ratio of about 11:1 diester to monoester; 86% solid in ethanol.

EXAMPLE I AND II—PROCESS

About 0.6 g of a HCl solution (25%) is added to about 893 g deionized water preheated to about 66° C. in a stainless steel mixing tank. The water seat is mixed with an IKA mixer (Model RW 20 DZM®) at about 1500 rpm using an impeller with about 5.1 cm diameter blades. About 101 g of an ester quaternary ammonium compound, containing about 86% di(soft tallowoyloxyethyl) dimethyl ammonium chloride in ethanol, pre-heated to about 66° C., is then slowly added to the water seat. About 0.6 g of a 25% $CaCl_2$ solution is added and the mixture is milled, using an IKA Ultra Turrax T-50® high shear mixer (at about 10,000 rpm), for about 5 min. The mixture is cooled during mixing, and about 4.5 g of perfume is added when the mixture temperature reaches about 30° C.

| Examples III–IV | | |
|---|---|---|
| Composition Components | III Wt. % | IV Wt. % |
| Hydroxyethyl Ester Quat[1] | 9.80 | — |
| Propyl Ester Quat[2] | — | 8.67 |
| Ethanol | — | 1.20 |
| HCl (25%) | 0.05 | 0.06 |
| Perfume A | 0.40 | — |
| Perfume B | — | 0.45 |
| Dye Solution | 0.08 | — |
| Kathon (1.50%) | 0.02 | 0.02 |
| $CaCl_2$ (25%) | 0.06 | 0.06 |
| Deionized Water | Balance | Balance |

[1]Di(tallowoyloxyethyl) (2-hydroxyethyl) methyl ammonium methyl sulfate, 85% active in ethanol.
[2]1,2-Di(hardened tallowoyloxy)-3-trimethylammoniopropane chloride.

EXAMPLE III—PROCESS

About 0.5 g of a HCl solution (25%) is added to about 896 g deionized water pre-heated to about 70° C. in a 1.5 L stainless steel mix tank. This "water seat" is mixed with an IKA mixer (Model RW 25®) at about 1000 rpm using an impeller with about 5.1 cm diameter blades. About 98 g of Stepanquat 6585-ET® containing 85% hydroxyethyl ester quat in ethanol, pre-heated to about 70° C., is then slowly added to the water seat, by injection at the impeller blades via a peristaltic pump. The mixture is cooled during mixing, and about 4 g of perfume, about 0.2 g of a 1.5% Kathon® solution, and about 0.8% of a dye solution are added when the mixture temperature reaches about 45° C. About 0.6 g of a 25% $CaCl_2$ is added when the mixture temperature reaches about 27° C. The mixing is stopped when the batch temperature reaches about 24° C.

EXAMPLE IV—PROCESS

About 0.6 g of a HCl solution (25%) is added to about 895 g deionized water pre-heated to about 74° C. in a 1.5 L stainless steel mix tank. The water seat is mixed with an IKA mixer (Model RW 20 DZM) at about 1000 rpm using an impeller with about 5.1 cm diameter blades. The mixture is also milled at the same time. A mixture of about 86.7 g of the propyl ester quat and 12 g of ethanol, pre-heated to about 82° C., is then slowly added to the water seat, injected at the impeller blades via a gravity-fed drop funnel. The mixer rpm is increased to about 1500 rpm during this addition. About 0.3 g of a $CaCl_2$ solution (25%) is added to reduce viscosity of the mixture and the mixer rpm is reduced to about 1000 rpm. About 0.2 g of a 1.5% Kathon solution is added. The mixture is chilled in an ice water bath while still mixing. The mill is turned off at this point. Another 0.3 g of the 25% $CaCl_2$ solution is added when the mixture temperature reaches about 27° C. The perfume is then added with mixing.

| Examples V and VI | | |
|---|---|---|
| Components | V Wt. % | VI Wt. % |
| Diester Compound[1] | 30.6 | 30.6 |
| Hydrochloric Acid | 0.018 | 0.0082 |
| Citric Acid | — | 0.005 |
| Liquitint ® Blue 651 Dye (1%) | 0.27 | 0.27 |
| Perfume A | 1.35 | — |
| Perfume B | — | 1.35 |
| Tenox ® 6 | 0.035 | — |
| Irganox ® 3125 | — | 0.035 |
| Kathon ® (1.5%) | 0.02 | 0.02 |
| DC-2210 Antifoam (10%) | 0.15 | 0.15 |
| $CaCl_2$ Solution (15%) | 4.33 | 3.33 |
| Deionized Water | Balance | Balance |
| pH = 2.8–3.5 | | |
| Viscosity = 35–60 cps. | | |

[1]Di(soft tallowoyloxyethyl) dimethyl ammonium chloride of Example I.

EXAMPLES V AND VI—PROCESS

The above compositions V and VI are made by the following process:

1. Separately, heat the diester compound premix with the Tenox® 6 (or Irganox® 3125) and the water seat containing HCl, citric acid (if used), and antifoam agent to 74° C. (Note: for Composition VI, the citric acid can totally replace HCl, if desired);
2. Add the diester compound premix into the water seat over about 5–6 minutes. During the injection, both mix (about 600–1,000 rpm) and mill (about 8,000 rpm with an IKA Ultra Turrax T-50 Mill) the batch.

3. Add about 500 ppm of $CaCl_2$ at approximately halfway through the injection.
4. Add 2,000 ppm $CaCl_2$ over about 2–7 minutes (about 200–2,500 ppm/minute) with mixing at about 800–1,000 rpm after premix injection is complete at about 65°–74° C.
5. Add perfume over 30 seconds at about 40° C.
6. Add dye and Kathon and mix for about 30–60 seconds. Cool batch to about 21°–27° C.
7. Add 2,500 ppm to 4,000 ppm $CaCl_2$ to the cooled batch and mix.

COMPARATIVE EXAMPLES VII, VIII AND IX

The compositions of the Comparative Examples VII, VIII and IX are prepared similarly to that of Example V, except that Comparative Perfumes C, D, and E, respectively, are used, instead of perfume A.

The following represents the perfume benefit of the present invention. Five loads of laundry, each composed of approximately 6 lbs. (about 2.75 kg) of clothing are washed with about 66 g of unscented Tide® Ultra detergent, and rinsed with about 20 gal. (about 77.5 liters) of water (of approximately 10 gr. hardness), the rinse water having a temperature of about 65° F. (about 18° C.). At the beginning of the rinse cycle, about 30 g of compositions of Examples V, VI, and Comparative Examples VII, VIII and IX are added to the rinse liquor, one composition to one load. Thereafter, the clothing is either machine dried for about 50 minutes (normal setting) or line-dried for 16 hours at room temperature. Analyses of the resulting fabrics show that the clothing treated with the compositions of Examples V or VI retain substantially more perfume than that treated with the compositions of Comparative Examples VII, VIII or IX. Furthermore, when stored under the same conditions, the compositions of Examples V and VI have the better viscosity stability, as compared to those of Comparative Examples VII, VIII, and IX.

Examples X and XI
Solid Particulate Compositions

| Components | X Wt. % | XI Wt. % |
|---|---|---|
| Ester Quat Compound[1] | 88 | 85.5 |
| Ethoxylated Fatty Alcohol[2] | 6 | — |
| Coconut Choline Ester Chloride | — | 8 |
| Perfume A | 3.5 | — |
| Perfume B | — | 4 |
| Tartaric Acid | 1 | — |
| Citric Acid | — | 0.25 |
| Minors (Antifoam, etc.) | 1 | 1 |
| Electrolyte | 1.5 | 1.25 |
| | 100 | 100 |

[1]Ester quat compound of Example II.
[2]$C_{16}$—$C_{18}E_{18}$.

EXAMPLES X AND XI—PROCESS

Molten ester quat compound is mixed with molten ethoxylated fatty alcohol or molten coconut choline ester chloride. The other materials are then blended in with mixing. The mixture is cooled and solidified by pouring on a metal plate, and then ground and sieved.

What is claimed is:

1. A rinse-added liquid fabric softening composition comprising:

(A) from about 0.5% to about 80% of biodegradable cationic fabric softening compound;

(B) from about 0.01% to about 10% of an enduring perfume which has at least about 70% of components with a ClogP≧3.0 and a boiling point of≧250° C., ClogP being the calculated octanol/water partitioning coefficient (P) expressed as the logarithm to the base 10, logP;

(C) optionally, from about 0% to about 30% of dispersibility modifier; and (D) the balance comprising a liquid carrier selected from the group consisting of: water, $C_{1-4}$ monohydric alcohol; $C_{2-6}$ polyhydric alcohol; propylene carbonate; liquid polyethylene glycols; and mixtures thereof;

and wherein the dispersibility modifier affects the viscosity of said liquid fabric softening composition.

2. The composition of claim 1 wherein the quaternary ammonium fabric softening compound has the formula:

$$(R)_{4-m}—^{+}N—[(CH_2)_n—Y—R^2]_m\ X^-$$

wherein: each Y is —O—(O)C—, or —C(O)—O—; m is 2 or 3; n is 1 to 4; each R is a $C_1$–$C_6$ alkyl group, hydroxyalkyl group, benzyl group, or mixtures thereof, each $R^2$ is a $C_{12}$–$C_{22}$ hydrocarbyl or substituted hydrocarbyl substituent; and $X^-$ is any softener-compatible anion.

3. The composition of claim 2 wherein the quaternary ammonium compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight.

4. The composition of claim 2 wherein the enduring perfume has at least about 75% of the total weight of components with a ClogP≧3.0 and a boiling point of ≧250° C.

5. The composition of claim 2 wherein the enduring perfume has at least about 80% of the total weight of components with a ClogP≧3.0 and a boiling point of ≧250° C.

6. The composition of claim 2 wherein the enduring perfume has at least about 85% of the total weight of components with a ClogP≧3.0 and a boiling point of ≧250° C.

7. The composition of claim 1 wherein the the enduring perfume has a least about 75% of the total weight of components with a ClogP≧3.0 and a boiling point of ≧250° C.

8. The composition of claim 1 wherein the enduring perfume has at least about 80% of the total weight of components with a ClogP≧3.0 and a boiling point of ≧250° C.

9. The composition of claim 1 wherein the enduring perfume has at least about 85% of the total weight of components with a ClogP≧3.0 and a boiling point of ≧250° C.

10. The composition of claim 1 wherein said enduring perfume composition is present at a level of from about 0.05% to about 8%.

11. The composition of claim 10 wherein said enduring perfume composition is present at a level of from about 0.1% to about 6%.

12. The composition of claim 11 wherein said enduring perfume composition is present at a level of from about 0.15% to about 4%.

13. The composition of claim 11 wherein the enduring perfume has a least about 85% of the total weight of components with a ClogP≧3.0 and a boiling point of ≧250° C.

14. The composition of claim 10 wherein the enduring perfume has a least about 75% of the total weight of components with a ClogP≧3.0 and a boiling point of ≧250° C.

15. The composition of claim 1 wherein said dispersibility modifier is selected from the group consisting of: single-long-chain-$C_{10}$–$C_{22}$ alkyl, cationic surfactant; nonionic surfactant with at least 8 ethoxy moieties; amine oxide surfactant; and mixtures thereof.

16. The composition according to claim 15 wherein the dispersibility modifier is a single-long-chain-alkyl cationic surfactant which is present in an effective amount to affect the viscosity of up to about 15% of the composition.

17. The composition according to claim 16 wherein the dispersibility modifier is a quaternary ammonium salt of the general formula:

$$[R^2N^+R_3]\ X^-$$

wherein the $R^2$ group is a $C_{10}$–$C_{22}$ hydrocarbon group, or the corresponding ester linkage interrupted group with a short alkylene ($C_1$–$C_4$) group between the ester linkage and the N, and having a similar hydrocarbon group, each R is a $C_1$–$C_4$ alkyl or substituted alkyl, or hydrogen; and the counterion $X^-$ is a softener compatible anion.

18. The composition according to claim 17 wherein the dispersibility modifier is $C_{12}$–$C_{14}$ choline ester.

19. The composition according to claim 15 wherein the dispersibility modifier is a nonionic surfactant which is present in an effective amount to affect the viscosity of up to about 15% of the composition.

20. The composition according to claim 19 wherein the dispersibility modifier is $C_{10\text{-}14}$ alcohol with poly(10–18)ethoxylate.

21. The composition according to claim 15 wherein the dispersibility modifier is amine oxide with one alkyl, or hydroxyalkyl, moiety of about 8 to about 22 carbon atoms and two alkyl moieties selected from the group consisting of alkyl groups and hydroxyalkyl groups containing from one to about three carbon atoms.

22. The composition of claim 1 wherein the composition comprises:

(A) from about 1% to about 35% of biodegradable quaternary ammonium fabric softening compound;

(B) from about 0.05% to about 6% of an enduring perfume composition;

(C) from about 0.5% to about 10% of dispersibility modifier wherein the dispersibility modifier affects the composition's viscosity, dispersibility in a laundry process rinse cycle, or both; and (D) the balance comprising a liquid carrier selected from the group consisting of water; $C_1$–$C_4$ monohydric alcohols; $C_2$–$C_6$ polyhydric alcohols; propylene carbonate; liquid polyalkylene glycols; and mixtures thereof.

23. The composition of claim 1 wherein the composition comprises:

(A) from about 15% to about 50% of biodegradable quaternary, ammonium fabric softening compound;

(B) from about 0.05% to about 6% of an enduring perfume composition;

(C) from about 0.5% to about 5% of dispersibility modifier wherein the dispersibility modifier affects the composition's viscosity; the balance comprising a liquid carder selected from the group consisting of water; $C_1$–$C_4$ monohydric alcohols; $C_2$–$C_6$ polyhydric alcohols; propylene carbonate; liquid polyalkylene glycols; and mixtures thereof, and wherein said composition further comprises from 0% to about 1% of a stabilizer; and from about 0.01% to about 2% electrolyte.

24. The composition of claim 23 wherein the quaternary ammonium fabric softening compound has the formula:

$$(R)_{4-m}—^+N—[(CH_2)_n—Y—R^2]_m\ X^-$$

wherein: each Y is —O—(O)C—, or —C(O)—O—; m is 2 or 3; n is 1 to 4; each R is a $C_1$– $C_6$ alkyl group, hydroxyalkyl group, benzyl group, or mixtures thereof; each $R^2$ is a $C_{12}$–$C_{22}$ hydrocarbyl or substituted hydrocarbyl substituent; and $X^-$ is any softener-compatible anion.

25. The composition of claim 24 wherein the quaternary ammonium compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight.

26. The composition of claim 24 wherein the enduring perfume has at least about 75% of the total weight of components with a ClogP≧3.0 and a boiling point of ≧250° C.

27. The composition of claim 24 wherein the enduring perfume has at least about 80% of the total weight of components with a ClogP≧3.0 and a boiling point of ≧250° C.

28. The composition of claim 24 wherein the enduring perfume has at least about 85% of the total weight of components with a ClogP≧3.0 and a boiling point of ≧250° C.

29. The composition of claim 24 wherein the level of said enduring perfume composition is from about 0.15% to about 4%.

30. The composition of claim 23 wherein the level of said enduring perfume composition is from about 0.15% to about 4%.

31. The composition of claim 1 wherein said enduring perfume composition contains at least 70% of materials selected from the group consisting of: Allyl cyclohexane propionate; Ambrettolide; Amyl benzoate; Amyl cinnamate; Amyl cinnamic aldehyde; Amyl cinnamic aldehyde dimethyl acetal; iso-Amyl salicylate; Hydroxycitronellal-methylanthranilate; Benzophenone; Benzyl salicylate; para-tert-Butyl cyclohexyl acetate; iso-Butyl quinoline; beta-Caryophyllene; Cadinene; Cedrol; Cedryl acetate; Cedryl formate; Cinnamyl cinnamate; Cyclohexyl salicylate; Cyclamen aldehyde; Dihydro isojasmonate; Diphenyl methane; Diphenyl oxide; Dodecalactone; 1-(1,2,3,4,5,6,7,8-Octahydro-2,3,8,8-tetramethyl-2-naphthalenyl)-ethanone; Ethylene brassylate; Ethylmethyl phenyl glycidate; Ethyl undecylenate; 15-Hydroxypentadecanoic acid, lactone; 1,3,4,6,7,8-Hexahydro-4,6,6,7,8,8-hexamethytcyclopenta-gamma- 2-benzopyran; Geranyl anthranilate; Geranyl phenyl acetate; Hexadecanolide; Hexenyl salicylate; Hexyl cinnamic aldehyde; Hexyl salicylate; alpha-Irone; para-tertiary-Butyl-alpha-methyl hydrocinnamic aldehyde; Linalyl benzoate; 2-Methoxy naphthalene; Methyl dihydrojasmone; gamma-n-Methyl ionone; Musk indanone; Musk ketone; Musk tibetine; Myristicin; Oxahexadecanolide-10; Oxahexadecanolide-11; Patchouli alcohol; 5-Acetyl-1,1,2,3,3,6-hexamethyl indan; Phenyl ethyl benzoate; Phenylethylphenylacetate; Phenyl heptanol; Phenyl hexanol; alpha-Santalol; delta-Undecalactone; gamma-Undecalactone;

Vetiveryl acetate; yara-yara; Ylangene; and mixtures thereof.

32. A solid particulate composition comprising:

(A) from about 50% to about 95% of biodegradable cationic fabric softening compound;

(B) from about 0.01% to about 15% of an enduring perfume composition which has at least about 70% of components with a ClogP≧3.0 and a boiling point of≧250° C.; ClogP being the calculated octanol/water partitioning coefficient (P) expressed as the logarithm to the base 10, logP;

(C) optionally, from 0% to about 30% of dispersibility improver; and (D) optionally, from 0% to about 15% of pH modifier.

33. The composition of claim 32 wherein the composition comprises:

(A) from about 60% to about 90% of biodegradable cationic, diester, quaternary ammonium fabric softening compound;

(B) from about 0.05% to about 8% of an enduring perfume composition;

(C) from 3% to about 15% of dispersibility modifier; and (D) optionally, from 0% to about 10% of pH modifier.

34. The composition of claim 32 wherein said enduring perfume composition contains at least 70% of materials selected from the group consisting of: Allyl cyclohexane propionate; Ambrettolide; Amyl benzoate; Amyl cinnamate; Amyl cinnamic aldehyde; Amyl cinnamic aldehyde dimethyl acetal; iso-Amyl salicylate; Hydroxycitronellal-methylanthranilate; Benzophenone; Benzyl salicylate; para-tert-Butyl cyclohexyl acetate; iso-Butyl quinoline; beta-Caryophyllene; Cadinene; Cedrol; Cedryl acetate; Cedryl formate; Cinnamyl cinnamate; Cyclohexyl salicylate; Cyclamen aldehyde; Dihydro isojasmonate; Diphenyl methane; Diphenyl oxide; Dodecalactone; 1-(1,2,3,4,5,6,7,8-Octahydro-2,3,8,8-tetramethyl-2-naphthalenyl)-ethanone; Ethylene brassylate; Ethylmethyl phenyl glycidate; Ethyl undecylenate; 15-Hydroxypentadecanoic acid, lactone; 1,3,4,6,7,8-Hexahydro-4,6,6,7,8,8-hexamethylcyclopenta-gamma- 2-benzopyran; Geranyl anthranilate; Geranyl phenyl acetate; Hexadecanolide; Hexenyl salicylate; Hexyl cinnamic aldehyde; Hexyl salicylate; alpha-Irone; para-tertiary-Butyl-alpha-methyl hydrocinnamic aldehyde; Linalyl benzoate; 2-Methoxy naphthalene; Methyl dihydrojasmone; gamma-n-Methyl ionone; Musk indanone; Musk ketone; Musk tibetine; Myristicin; Oxahexadecanolide-10; Oxahexadecanolide-11; Patchouli alcohol; 5-Acetyl-1,1,2,3,3,6-hexamethyl indan; Phenyl ethyl benzoate; Phenylethylphenylacetate; Phenyl heptanol; Phenyl hexanol; alpha-Santalol; delta-Undecalactone; gamma-Undecalactone; Vetiveryl acetate; yara-yara; Ylangene; and mixtures thereof.

* * * * *